US006270864B1

(12) United States Patent
Weiss

(10) Patent No.: US 6,270,864 B1
(45) Date of Patent: Aug. 7, 2001

(54) ARTIFICIAL CHRISTMAS TREE WITH STAND

(76) Inventor: Gerhard Weiss, Hopfenstrasse 13, D-84098 Schmatzhausen (DE)

( * ) Notice: Subject to any disclaimer, the term of this patent is extended or adjusted under 35 U.S.C. 154(b) by 0 days.

(21) Appl. No.: 09/064,585

(22) Filed: Apr. 22, 1998

(51) Int. Cl.[7] ..... A47G 33/06; A47G 33/12

(52) U.S. Cl. ..... 428/18; 428/19; 428/20; 362/123

(58) Field of Search ..... 428/18, 19, 20; D11/118; 362/123

(56) References Cited

U.S. PATENT DOCUMENTS 1,490,409 * 4/1924 Ventresca .
3,544,783 * 12/1970 Williams .

* cited by examiner

*Primary Examiner*—Deborah Jones
*Assistant Examiner*—Jason Savage
(74) *Attorney, Agent, or Firm*—Pitney, Hardin, Kipp & Szuch LLP

(57) ABSTRACT

An artificial Christmas tree is provided which consists of a stand base, a stand pillar, at least two truncated-cone elements conically grauated in terms of size, an a conical element for the top of the tree. The elements are detachably fastened to each other so a to form a stylized tree which can be easily disassembled for storage.

3 Claims, 5 Drawing Sheets

ARTIFICIAL CHRISTMAS TREE WITH STAND

The present invention relates to an artificial Christmas tree with stand in accordance with the introductory clause of claim 1 of the type known from the U.S. Pat. No. 1,490,409 and U.S. Pat. No. 3,544,783.

In view of the background of a spreading awareness of environmental aspects and the criticised cutting-down of natural Christmas trees every year, which perform their function only two weeks and must then be disposed of, there is a need for the creation of an artificial Christmas tree suitable for re-use every year.

What is also known are plastic imitations of natural Christmas trees. Such artificial Christmas tree imitations are usually very bulky and require an appropriate storage capacity for the period in which they are not used, i.e. approximately 50 weeks a year, which space is not available at any place, Such plastic Christmas trees involved moreover a high expenditure of a final disposal after a prolonged period of service. There is hence a need for the creation of an artificial Christmas tree with a pleasing appearance which may be disassembled when it is not used and which can be stored in a compact form.

In accordance with the present invention an artificial Christmas tree is provided which consists of the following elements for stacking one on top of the other: a stand base, a stand pillar, at least two truncated-cone elements conically graduated in terms of size, and a conical element for the top of the tree, with elements are detachably fastened to each other so as to form a stylised tree.

On account of the inventive design of the artificial Christmas tree with a stand it is easy even for persons with reduced engineering talents and skills to set up, in case of need, an attractive stylised Christmas tree without any problems, using individual sections which do not create any problems in storage, and to disassemble the tree later on.

In accordance with the invention each truncated-cone element comprises a circular board adapted to be attached in the region of its bottom and top sides, which boards are adjacent to each other when the stylised tree is formed, and which include complementary plug-and-socket or screw connectors or Velcro-type devices, respectively. With these provisions the truncated-cone elements may be easily stored one inside the other and the circular boards are easily stacked when the tree is not used, so that the required storage capacity is kept at a minimum.

What is moreover expedient for the attractive appearance of the stylised Christmas tree is the provision that the circular board forming the bottom side is attached on the truncated-cone elements and the conical element with an inward offset, so that fastening brackets for suspending decorative items may preferably be disposed also in the region of the lower ends of the conical shells, It is furthermore expedient for the further stylised approximation to a Christmas tree to provide receiving elements for candle holders, decorative or ornamental items in the conical shell surfaces, which elements are preferably formed by threaded sleeves, and to design the shell surfaces of the truncated-cone elements and of the conical element for receiving coloured and decorative coatings. The tip of the conical element may be additionally provided with an further decorative top.

The inventive artificial Christmas tree includes a stand which is preferably of a two-piece design and preferably vertically adjustable. In a preferred embodiment of the invention, this stand pillar is suitable for attachment by its first end on the stand base and by its other end in the area of the underside of the largest truncated-cone element. Moreover provisions are expediently made for screw-mounting the stand pillar both in the stand base and in the underside of the largest truncated-cone element, with a retaining plate being provided on the side of the stand pillar for securing the underside of the largest truncated-cone element. In an alternative design, the stand pillar mount may equally be provided with one or several plug-and-socket connectors, too.

The stand base as such presents preferably a circular and/or polygonal plate-shaped design, with perforations in the form of geometric figures such as triangles or circles being provided in a preferred embodiment.

The two or more truncated-cone elements and the conical element consist either of wood, such as steamed beechwood, of synthetic material or varnished or lacquered paperboard or millboard, of metal or of veneer, cardboard, hardboard plywood or plastic material. As far as the outside design of the artificial Christmas tree is concerned numerous variants are conceivable, e.g. in purely natural wood or in the form of coloured coatings, e.g. based on natural wood or in green or red or blue with silver or golden stars, etc. Various ornamental items may, of course, also be applied on the shell surfaces. The receiving elements provided for the candle holders, decorative or ornamental items may, for instance, also receive angles, figures, Santa Claus figures or the like, and even electric candles with the associated electric plug-and-socket connectors may be provided between the individual elements.

Depending on the selected material, it is also possible to provide fitting reinforcements in the form of glued-in profiled elements, e.g. triangles, for attachment of the lower circular board on the truncated-cone element, whereas for reasons of stability the upper circular board or terminating board is expediently glued to the respective truncated-cone elements.

An integral threaded sleeve may also be provided as a receiving element for the tip of the conical element, which is closed, for instance, by a plastic part and may be removed for insertion of an additional decorative top, e.g. in the form of a glossy arrow.

The stand pillar may be composed of two telescopic elements so as to be vertically adjustable, which elements may be secured by means of a crossbolt relative to each other in specified withdrawn positions. In an alternative embodiment, it is also possible to achieve a fixation at a desired height with such a two-piece telescopic formation of the stand pillar by a frictional resistance operative between the two parts, i.e. in a force-locking manner, or in any other simple appropriate way.

In the following, the invention will be explained in more details with reference to the attached drawings wherein:

FIG. 1 illustrates a schematic side view of an embodiment of an artificial Christmas tree 10. The Christmas tree 10 includes a stand base 11, a vertically adjustable two-piece stand pillar 12 engaging the underside of a truncated-cone element 14 through a retaining plate 13, a comparatively smaller truncated-cone element 15 and another even smaller conical element 16 which forms the top of the Christmas tree 10.

Axial holes 17 are roughly indicated in the vertically adjustable two-piece stand pillar 12, through which a cotter pin (not illustrated here) may be inserted for securing the adjusted height of the stand pillar 12, i.e. the relative position of its two elements.

Figure 2:
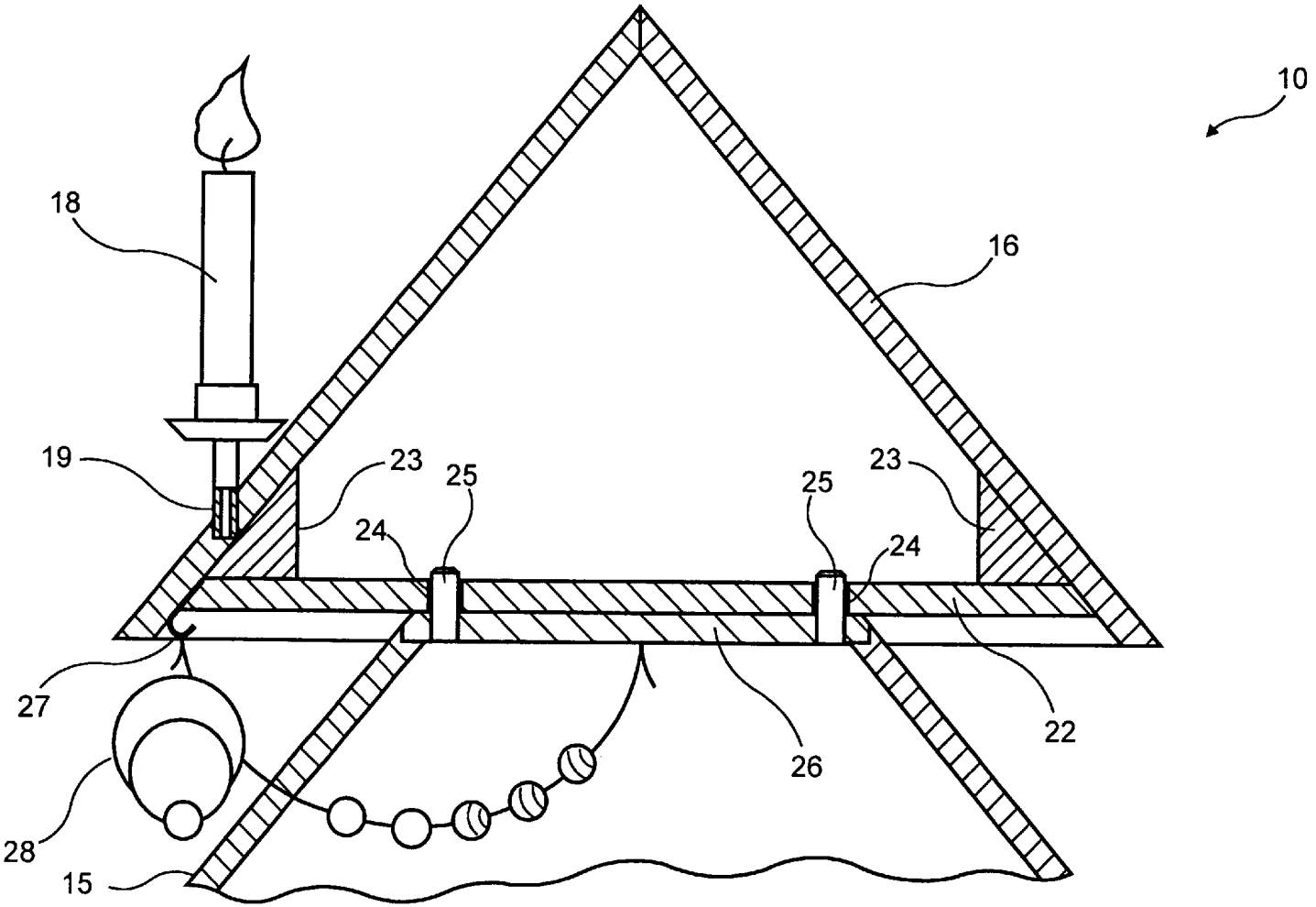
FIG. 2 shows an enlarged sectional view taken in the region of the top of the Christmas tree.

Candles are disposed on the truncated-cone elements 14 and 15 and on the conical part 16 in a mutually spaced relationship; these candles are mounted in appropriate receiving elements or holders 18, as is shown in more details n FIG. 2, which are mounted in the shell surface of the respective truncated-cone elements 14 and 15 and of the conical part 16 in parallel with the longitudinal axis of the Christmas tree 10. An ornamentation 50 is applied on the shell surfaces of the truncated-cone elements 14 and 15, and on the underside of the truncated-cone element 15 and of the conical part 16 a hanging Christmas-tree decoration 20 is provided, e.g. in the form of a chain.

Figure 5:
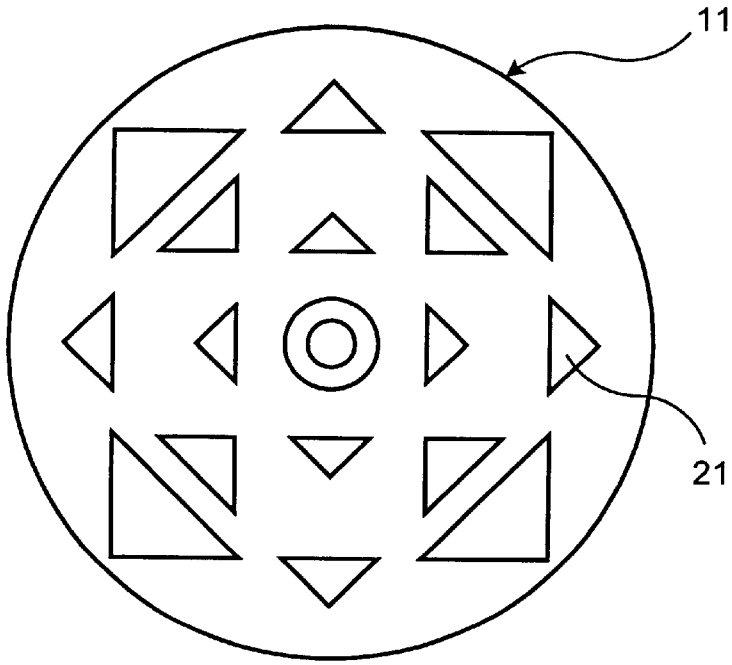
FIG. 5 shows a plan view of an embodiment of a stand base.
Figure 6:
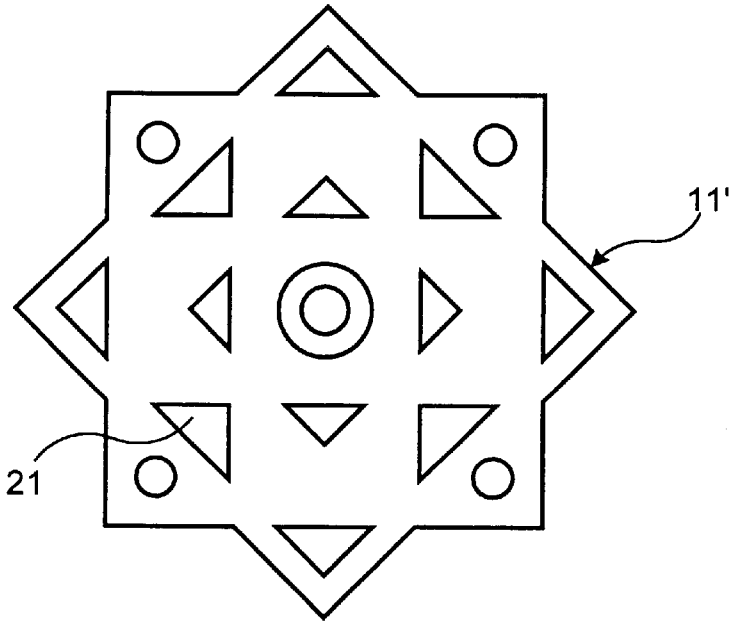
FIG. 6 is a plan view of a modified stand base.

The simplest design of the stand base 11 presents a solid plate and, in accordance with FIG. 5, it may also be provided in the form of a circular board with regular moulded areas and perforations in the form of geometric figures, or as star-shaped board 11' in accordance with FIG. 6 with perforations in the form of geometric FIGS. 21.

FIG. 2 is an enlarged section taken through the upper segment of the artificial Christmas tree 10. The conical element 16 includes a circular board 22 fastened with an inward offset on the underside, which bears against four glued-in triangles 23 at equal radial spacings and is mounted thereon. The circular board 22 is provided with holes 24 disposed in symmetry with the longitudinal axis of the Christmas tree 10 for the passage of cotter pins 25 which are fastened, in their turn, on an upper circular board 26. The upper circular board 26 forms the upper termination of the truncated-cone element 15 and is attached on the latter. Fastening brackets 27 for suspension of decorative items 28 are provided in a hidden arrangement below the circular board 22.

Figure 3:
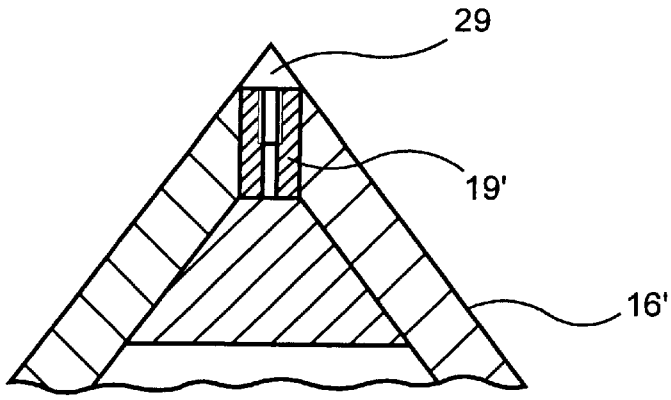
FIG. 3 is a modified illustration of the topmost tip of the Christmas tree with an integrated receiving element.
Figure 4:
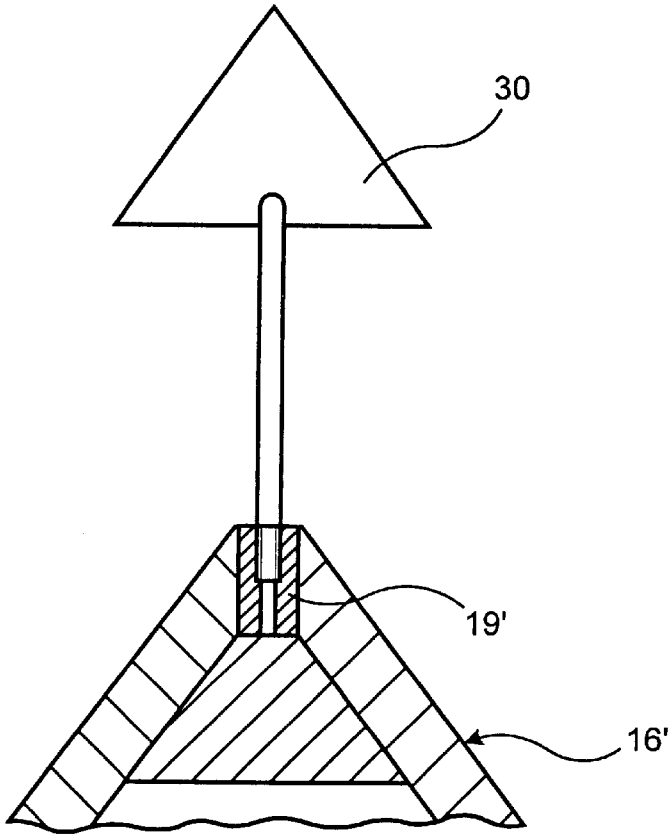
FIG. 4 is a view in correspondence with FIG. 3, with an inserted additional decorative top.

FIG. 3 shows a modified conical element 16' where a connector 19' is provided in the top, which is normally closed with an insertable decorative top 29 which may, however, be removed, in accordance with FIG. 4, when an additional decorative top 30 is inserted, e.g. in the form of a glossy arrow. It is also possible to dispose angels, figures and other figurative and decorative elements mounted with a screw-in thread on a shaft in the sleeves 19' on the top of the conical element 16' as well as in the shell surfaces of the conical element 16' and the truncated-cone elements 15 and 16, either alternatively or in alternation, depending on the decorative taste.

Figure 1:
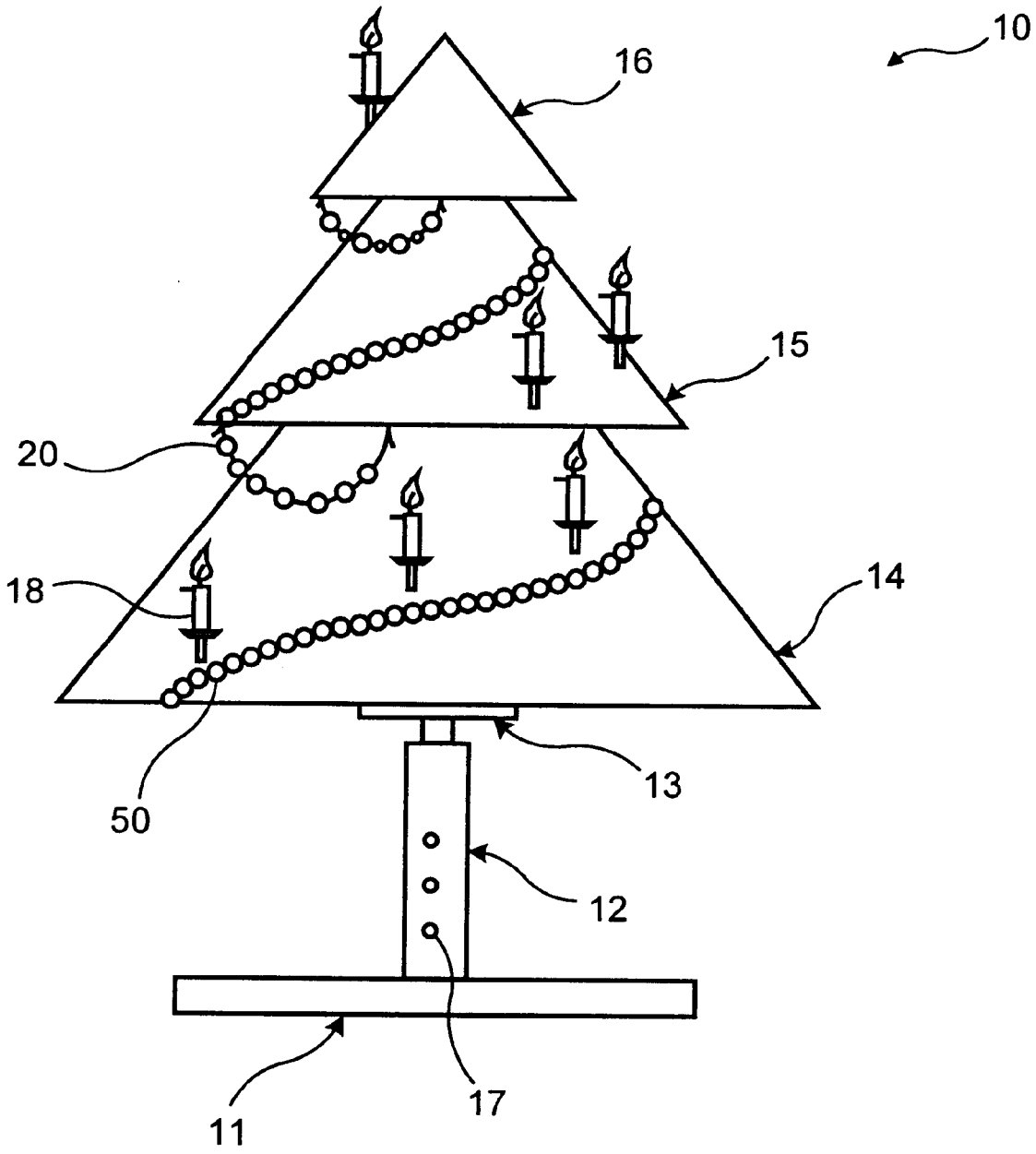
FIG. 1 is a side view of an embodiment of an artificial Christmas tree with stand.
Figure 7:
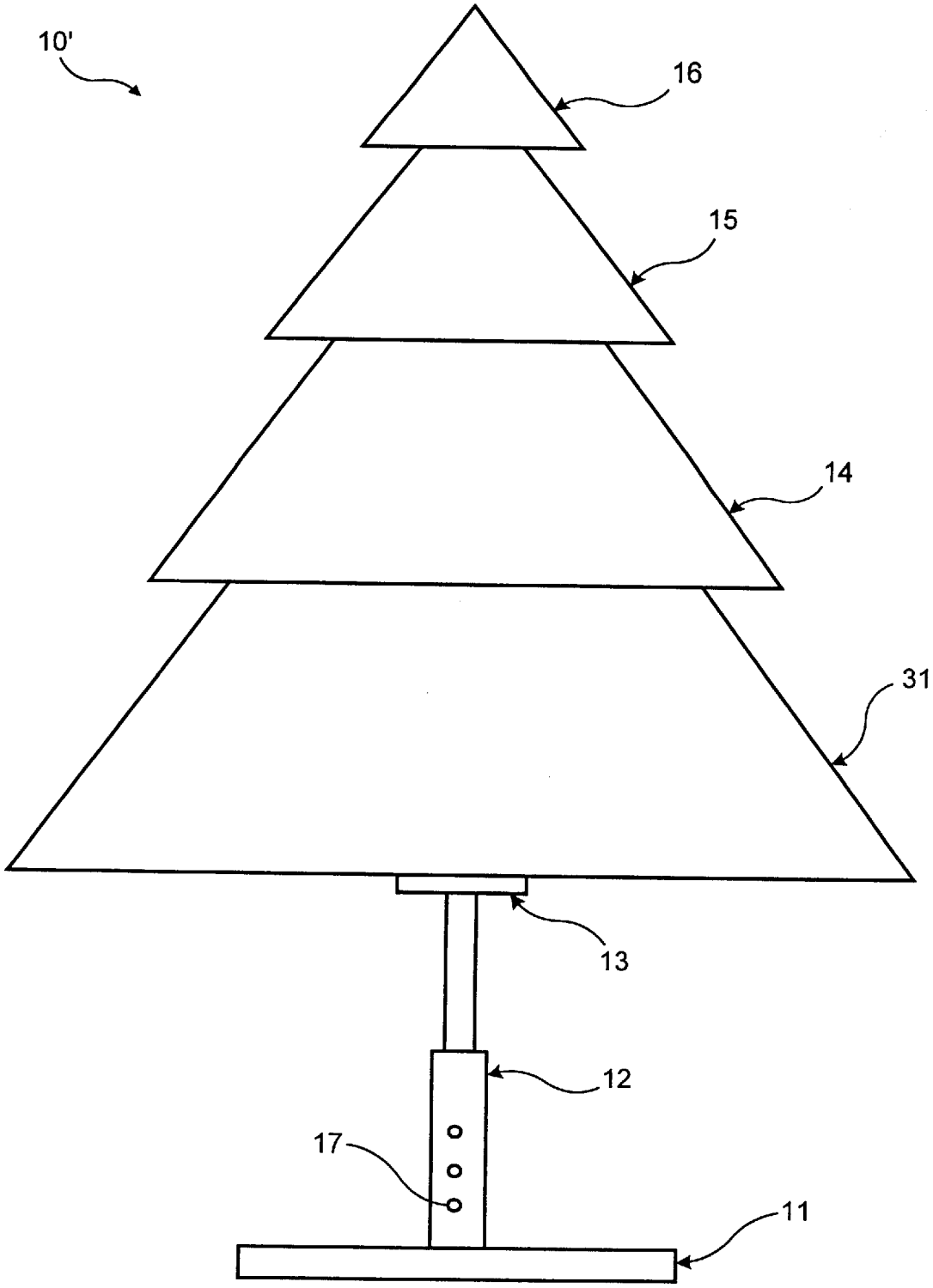
FIG. 7 illustrates another embodiment of an artificial Christmas tree with stand and three truncated-cone elements in a schematic side view.

FIG. 7 shows another embodiment of an artificial Christmas tree 10' where candles and decorative elements shown in FIG. 1 have been omitted for the sake of simplification, and which corresponds in all other respects of its design to the design of the Christmas tree 10 in FIG. 10, except for the feature that a further truncated-cone element 31 is provided which is comparatively larger than the truncated-cone element 14 and which is fastened by its underside on the stand pillar 12 and by its upper side below the truncated-cone element 14. Like in the first embodiment, the heights of the truncated-cone elements 31, 14, 15 and of the conical part 16 are so dimensioned that when the Christmas tree 10 is disassembled all the truncated-cone and conical elements may be stacked one inside the other in a space-saving manner such that all the parts fit into the truncated-cone element 14 or 31, respectively, without exceeding the height of the latter.

What is claimed is:

1. Artificial Christmas tree with stand, comprising the following stacked one on top of another:

a stand base (11, 11'), a stand pillar (12), at least two truncated-cone elements (14, 15, 31) conically graduated in terms of size, and a conical element (16, 16') for the top of the tree, with elements are provided for being detachably fastened to each other so as to form a stylised tree, wherein each truncated-cone element (14, 15, 31) includes a circular board (22, 26) adapted to be attached in the area of its underside and its upper side, and that said conical element (16, 16') includes a circular board (22) attached in the area of its underside;

wherein said stand pillar (12) is detachably attached by one end on said stand base (11, 11') and by its other end in the region of the underside of the largest one of the said truncated cone elements (14 or 31, respectively);

wherein said stand pillar (12) attaches through a retaining plate (13) mounted thereon to the underside of the largest one of said truncated-cone elements (14 or 31, respectively.

2. Artificial Christmas tree with stand, comprising the following stacked one on top of another:

a stand base (11, 11'), a stand pillar (12) of a two-piece design, at least two truncated-cone elements (14, 15, 31) conically graduated in terms of size, and a conical element (16, 16') for the top of the tree, with elements are provided for being detachably fastened to each other so as to form a stylised tree, wherein each truncated-cone element (14, 15, 31) includes a circular board (22, 26) adapted to be attached in the area of its underside and its upper side, and that said conical element (16, 16') includes a circular board (22) attached in the area of its underside.

3. Artificial Christmas tree with stand, comprising the following stacked one on top of another:

a stand base (11, 11'), a vertically adjustable stand pillar (12), at least two truncated-cone elements (14, 15, 31) conically graduated in terms of size, and a conical element (16, 16') for the top of the tree, with elements are provided for being detachably fastened to each other so as to form a stylised tree, wherein each truncated-cone element (14, 15, 31) includes a circular board (22, 26) adapted to be attached in the area of its underside and its upper side, and that said conical element (16, 16') includes a circular board (22) attached in the area of its underside.

* * * * *